United States Patent [19]

Tozier

[11] Patent Number: 4,999,928

[45] Date of Patent: Mar. 19, 1991

[54] AIR CONCENTRATION NOZZLE

[76] Inventor: Michel C. Tozier, P.O. Box 858, Durham, Calif. 95938

[21] Appl. No.: 415,569

[22] Filed: Oct. 2, 1989

[51] Int. Cl.[5] ..... F26B 19/00

[52] U.S. Cl. ..... 34/90; 34/97

[58] Field of Search ..... 34/97, 99, 96, 101, 34/90, 91; 219/373; 239/389; 138/162, 167, 168

[56] References Cited

U.S. PATENT DOCUMENTS

| | | | |
|---|---|---|---|
| 180,006 | 4/1957 | Barth . | |
| 214,976 | 8/1969 | Talge et al. . | |
| 253,011 | 9/1979 | Wristrand . | |
| 276,084 | 10/1984 | Long . | |
| 1,070,716 | 8/1913 | Myers . | |
| 2,654,161 | 10/1953 | Bowen | 34/99 |
| 2,846,777 | 8/1958 | Collins | 34/99 X |
| 3,319,350 | 5/1967 | Hlubik . | |
| 4,815,219 | 3/1989 | Binger | 34/91 X |

*Primary Examiner*—Henry A. Bennet

[57] ABSTRACT

An air concentrating nozzle is provided in a flat patterned body manufactured of light weight plastic or paper. The patterned body can be rolled into a cone and maintained cone shaped by inherent fasteners holding the edges together. In cone shape, a small opening at a first end concentrates air discharge and a large opening at a second end adapts the cone as a universal fitting for attachment over a majority of barrels used on home type hand-held hair dryers. An elastic loop attached to the air concentration nozzle fits around the hair dryer motor housing holding the air concentration nozzle in place.

4 Claims, 6 Drawing Sheets

AIR CONCENTRATION NOZZLE

BACKGROUND OF THE INVENTION

1. Field of the Invention:

This invention relates to air concentration nozzles with the present invention particularly directed towards an attachable cone useful with hand-held hair dryers.

2. Description of the Prior Art:

A cross section of the developing art seems most prevalent in the following U.S. Patents:

U.S. Pat. No. 1,070,716 shows a box fitted over a heater with a curved upper section arranged above a chair. The device is evidently useful for drying the hair of a person seated on the chair. Heat is directed but not concentrated in the patent issued to Myers on Aug. 19, 1913.

U.S. Pat. No. Des. 180,006 shows a reverse cone for use with a portable dryer at the narrow end. The device spreads heat rather than concentrates it. The patent was issued to Barth on Apr. 9, 1957.

U.S. Pat. No. 3,319,350 shows a tubular air director with a split end which allows the user to dry a single curl of hair at a time. The device directs air but is not useful as an air concentrator. The patent was issued to Hlubik on May 16, 1967.

U.S. Pat. No. Des. 214,976 shows a narrow nozzle useful in hair treatment. The patent was issued to Talge and Briar on Aug. 12, 1969.

U.S. Pat. No. Des. 253,011 shows a dryer with an elbow concentrator. The patent was issued to Wistrand on Sept. 25, 1979.

U.S. Pat. No. Des. 276,084 shows a pulsator attachment for a hair dryer. The device has vanes in a circular head which causes air passed through to pulsate. The patent was issued to Long on Oct. 23, 1984.

Air cones designed for quick temporary attachment shown in past art patents appear to be structured for widening the air flow as is illustrated in U.S. Pat. No. Des. 180,006. Attaching other devices removably and easily with a simple fastening method to different sized barrels of hand-held hair dryers is not seen in past art disclosures. Most nozzles described as being useful for concentrating air flow require special attachments or inherent structure with the air supply device.

SUMMARY OF THE INVENTION

Therefore, to overcome deficiencies seen in the past art devices, in practicing my invention, I provide an air concentration nozzle according to the invention in a cone removably attachable to a hand-held hair dryer barrel. The cone structure is developed in a flat patterned body arranged to be rolled into cone form. The sides of the cone are fastened together by inherent attachments which include tabs along one slanted cone side and tab retainer slits aligned adjacent an opposite cone side. The tabs and slits interlock to attach the cone sides together and maintain the cone shape. My air concentration nozzle in cone form provides a small first end opening sized for concentrating air which passes through the cone. A large second end has an opening sized and arranged as a universal attachment to fit over different sized air discharge barrels of different models of hand-held hair dryers. Although retaining the air concentration nozzle temporarily operationally positioned on the dryer barrel can be accomplished by either internal compression vanes or spiral threads inside the nozzle cone, I prefer an elastic loop fastened to the large second end of the cone and looped around the motor housing of the hand-held hair dryer. This makes attaching and detaching the air concentration nozzle easy. A flat patterned body allows the air concentration nozzle to be easily manufactured inexpensively by die cutting multiples of the patterned body from thin plastic and paper materials.

With my air concentrating nozzle installed, a home type hand-held hair dryer becomes effective for heat shrinking plastics for the covering of handles with plastics having heat shrink characteristics and for other uses where directed concentration of heat from a hand-held hair dryer source might be applicable. My cone has a patterned body which can be die stamped flat, has inherent attachments for making it into a cone, and can be packaged flat singularly and in multiples according to packaging requirements. My cone is disposable, particularly when structured of biodegradable paper.

Therefore, a principal object of my invention is to provide an air concentration nozzle in the form of a flat patterned body which can be configured into a cone removably attachable by universal fit to different sized barrels of home type hand-held hair dryers.

Another object of the invention is to provide a cone pattern which can be die cut flat from thin plastic or paper and has inherent attachments allowing it to be rolled into a cone shape and maintain the cone shape by fastening the opened edges together using the inherent attachments without requiring auxiliary fasteners.

A further object of my invention is to provide an air concentrating nozzle in cone shape which can be fastened temporarily to the nozzle of a hand-held hair dryer by pressure activated structure or by a pliable band looped around the hair dryer housing.

A still further object of the invention is to provide a cone useful with a hand-held hair dryer which can be inexpensively manufactured of thin plastic or paper and is disposable after use.

A still further object of the invention is to provide a cone attachable temporarily to the barrel of a home type hand-held hair dryer adapting the hair dryer for concentrating sufficient heat to be useful for shrinking plastic coverings having heat shrink characteristics onto handles.

Other objects and the many advantages of the immediate invention will be understood by reading numbered parts described in this specification and comparing the described parts with similarly numbered parts illustrated in the accompanying drawings.

DESCRIPTION OF THE PREFERRED EMBODIMENT

Figure 1:
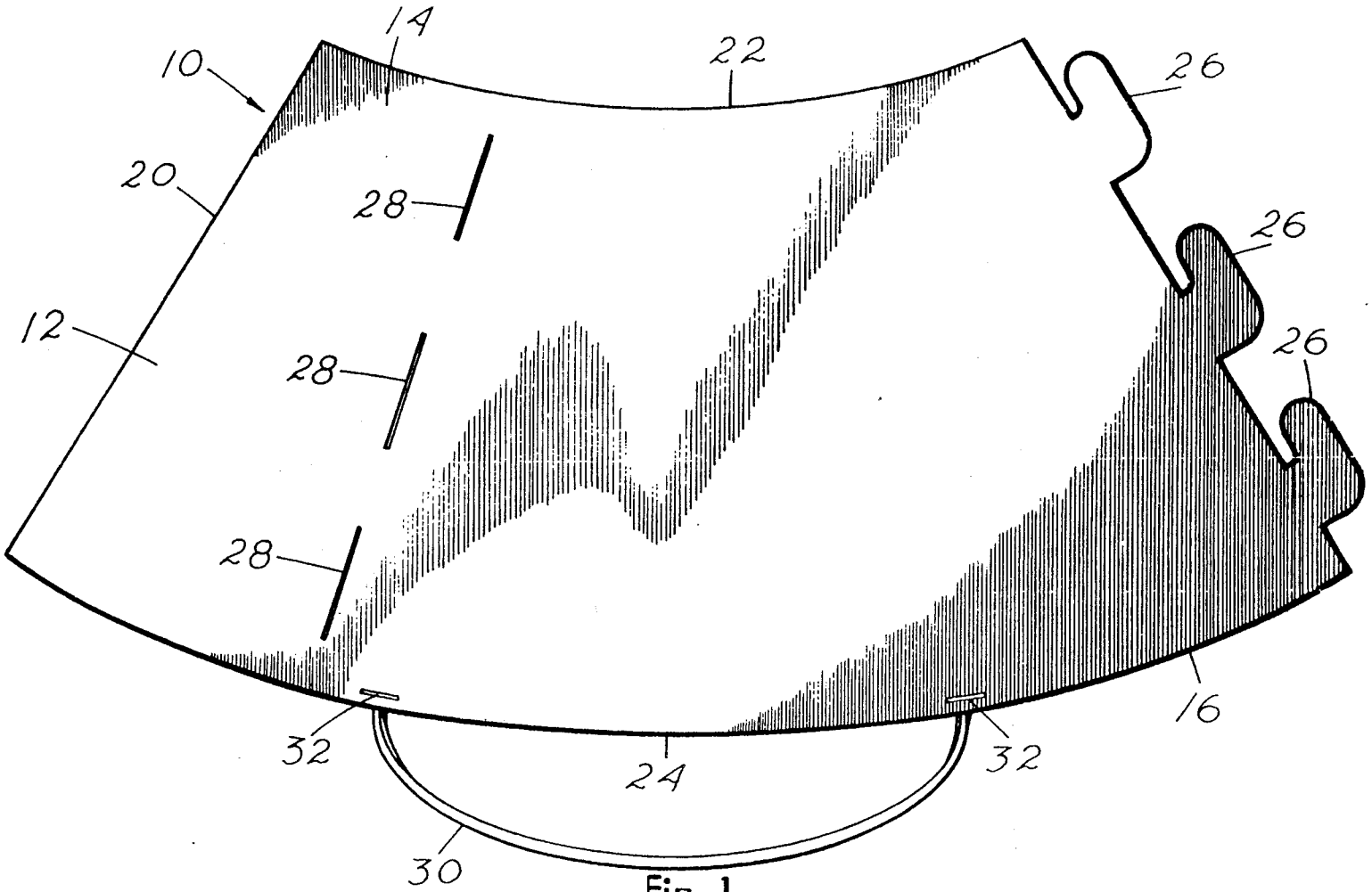
FIG. 1 shows the patterned body structure of the air concentration nozzle according to the invention laid flat in pattern form for die cutting. Inherent fastener tabs shown on the right side of the flat cone body in the illustration interlock into inherent tab retainer slits shown left adjacent the left cone body side edge maintain the shape when the material is rolled into cone form. An elastic loop for fastening the cone to a hand-held hair dryer is shown attached to the lower curved end of the patterned body in the illustration.
Figure 2:
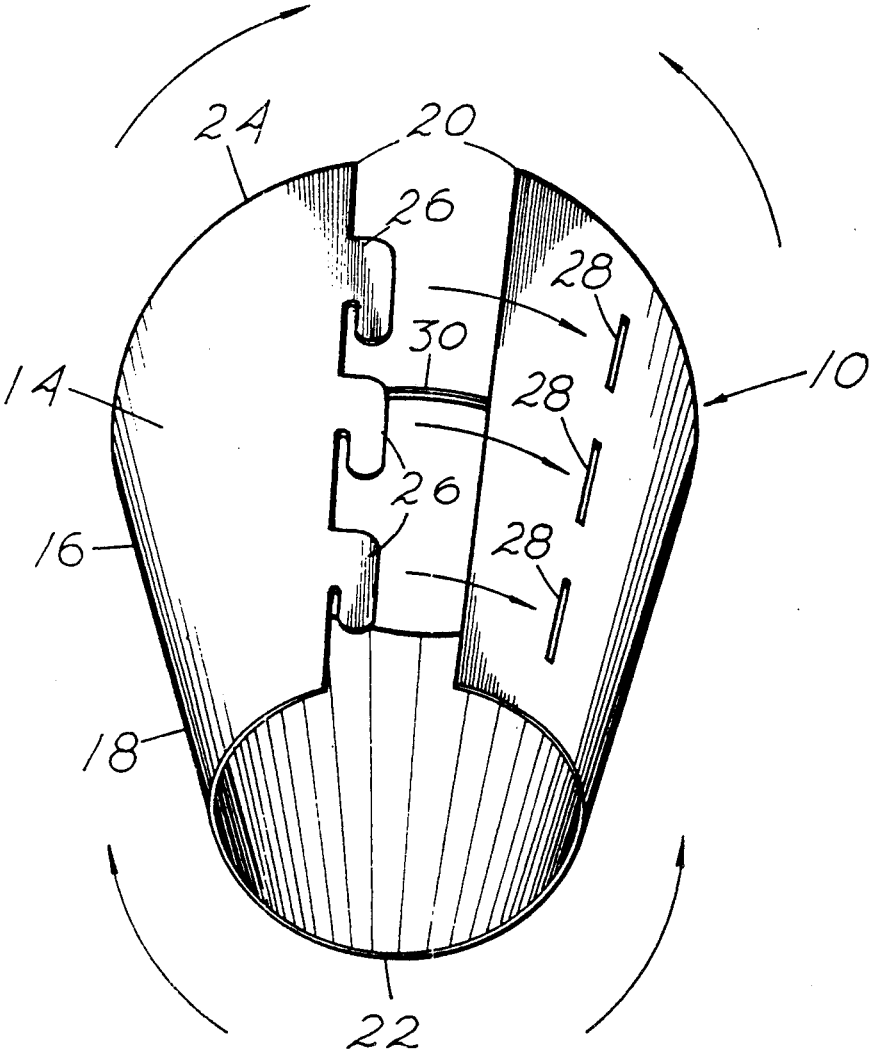
FIG. 2 is a perspective drawing showing the nozzle body material of FIG. 1 being rolled into a cone illustrating movement for rolling the die cut material into a cone and the positioning of the fastener tabs for interlocking into the retainer slits.
Figure 3:
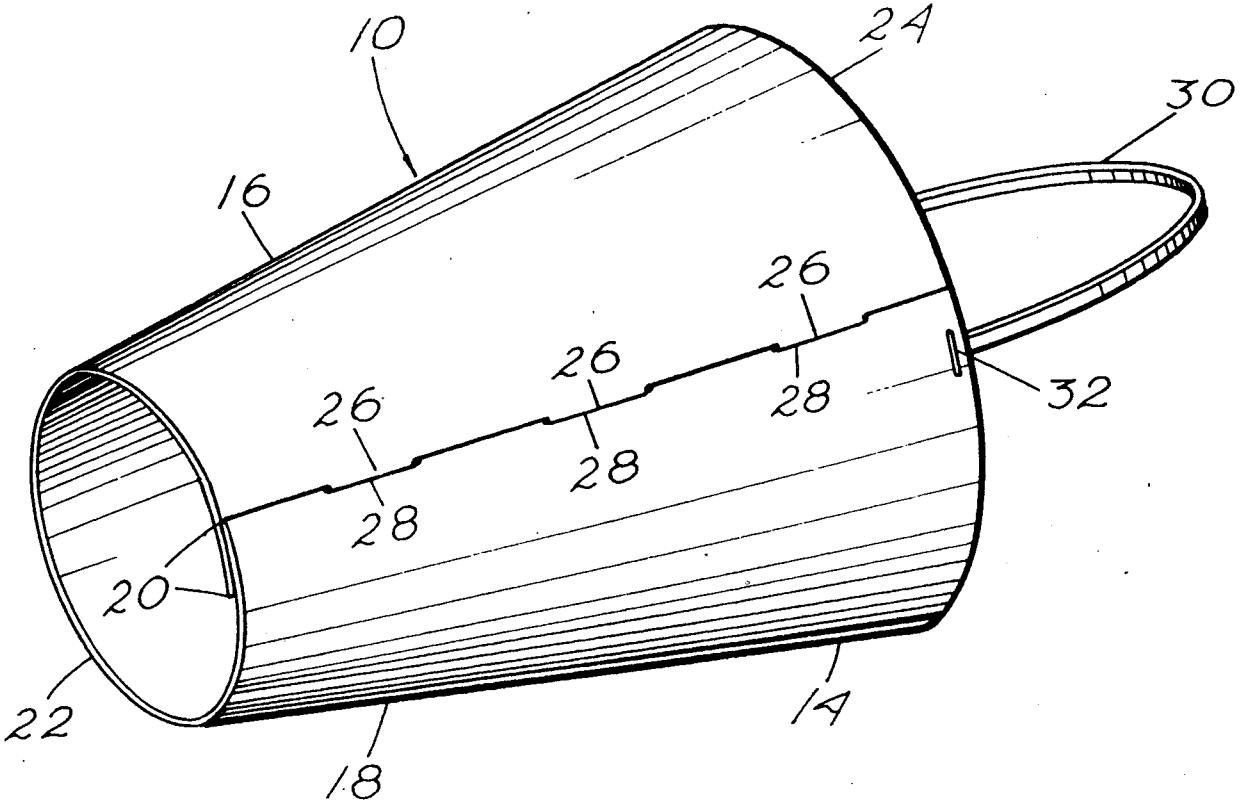
FIG. 3 is a perspective drawing of the assembled air concentration nozzle with the cone shape maintained by inherent fastener tabs interlocked into inherent tab retainer slits. The elastic hair dryer attachment loop is shown attached at the wide end of the cone.
Figure 4:
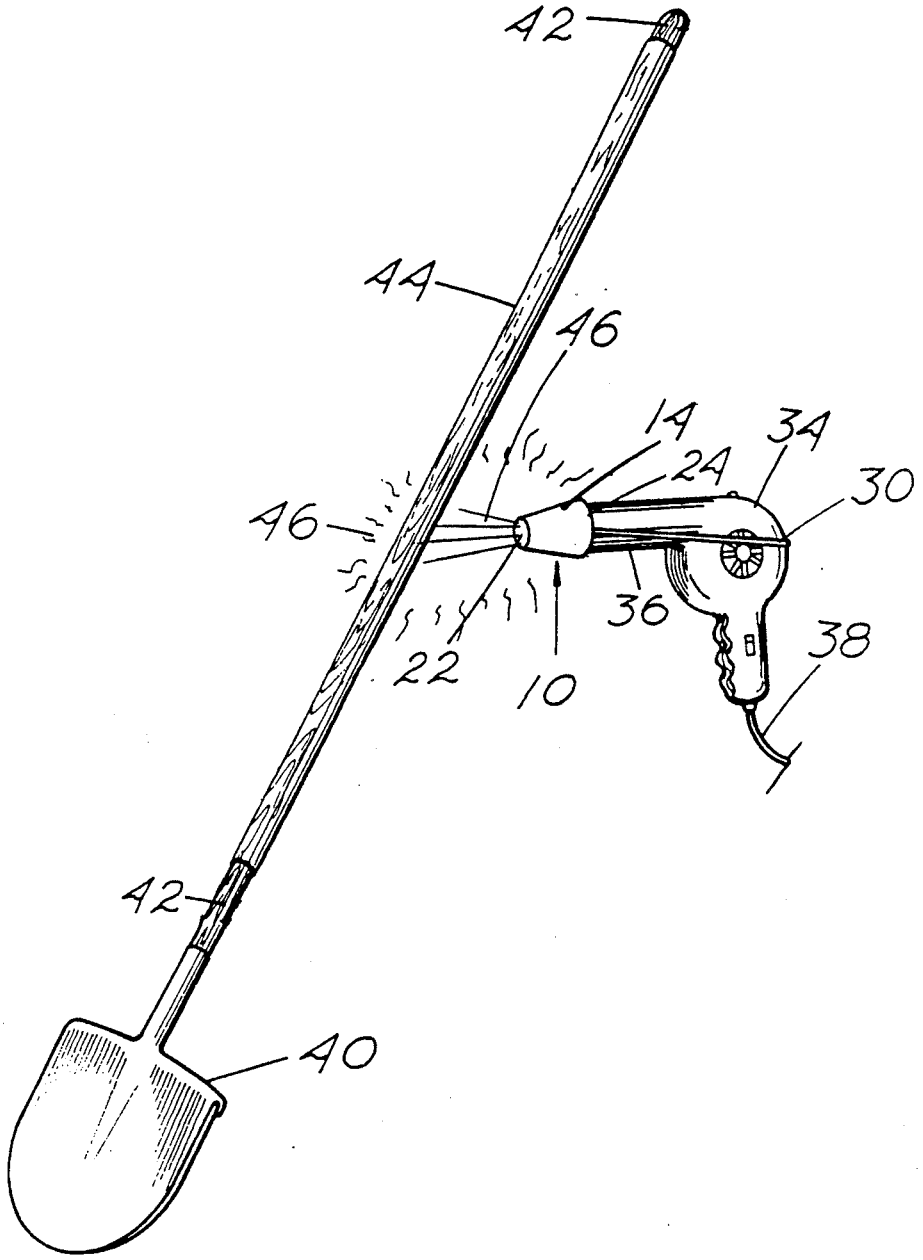
FIG. 4 illustrates the cone of the air concentration nozzle attached to the barrel of a hand-held hair dryer retained by an elastic band around the hair dryer motor housing and in use for concentrating heat to shrink a heat shrink plastic covering onto a shovel handle.
Figure 5:
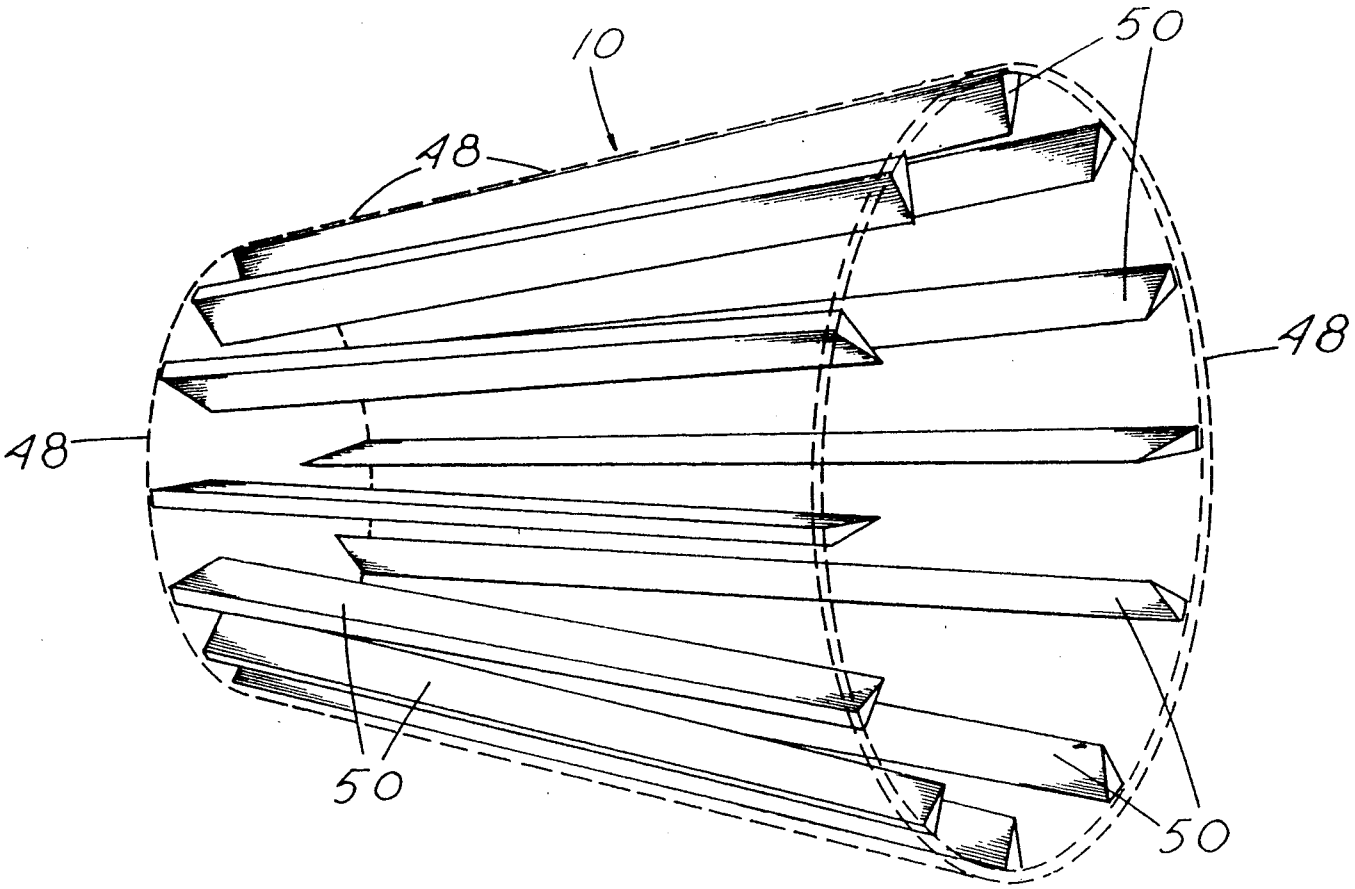
FIG. 5 shows a dotted outline of the air concentration nozzle affixed with compression fins as a method for universal attachment and retention of the cone to different sized hand-held hair dryer barrels.
Figure 6:
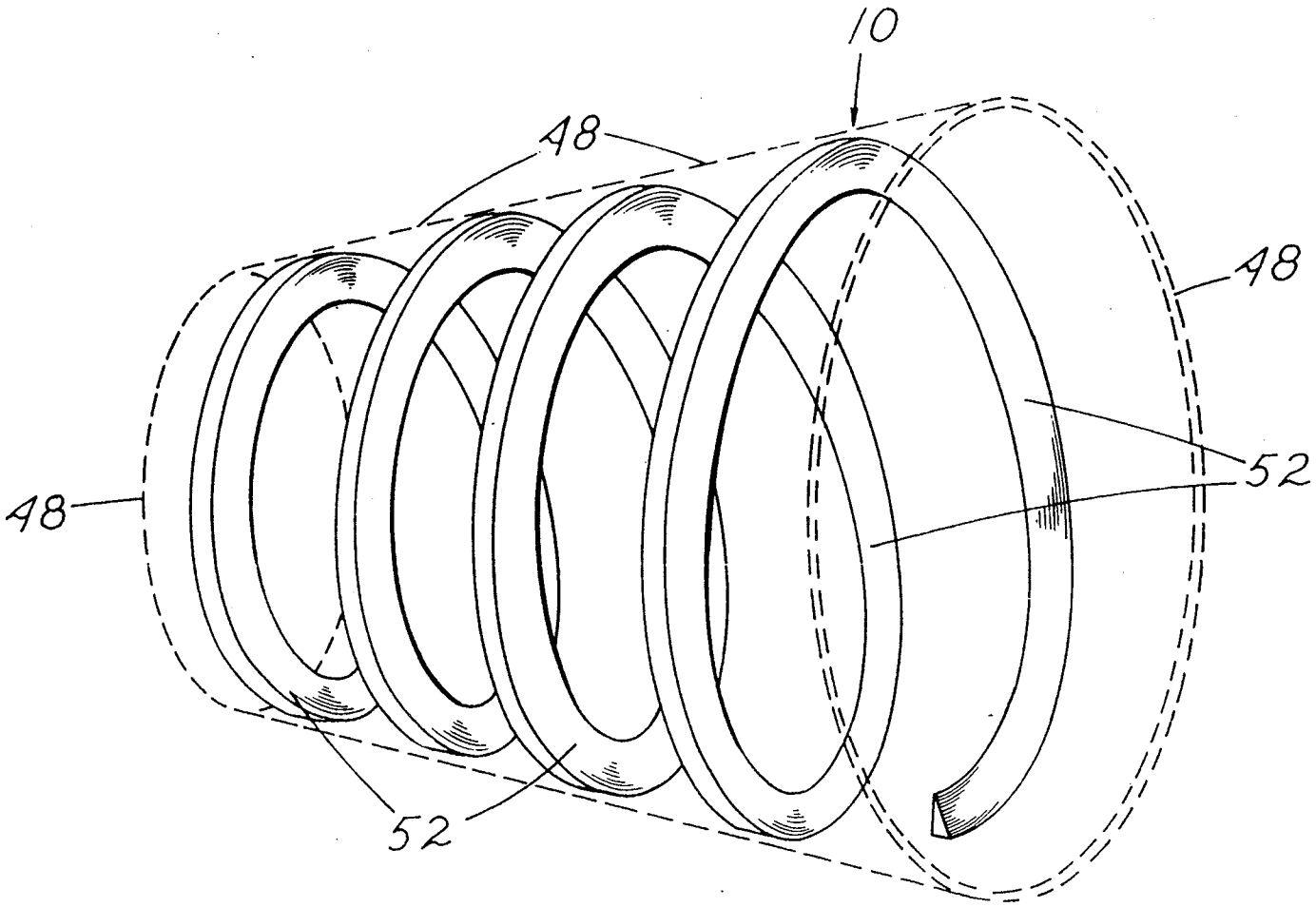
FIG. 6 shows the air concentration nozzle in dotted outline illustrating a threaded spiral wall surface inside the cone for universal attachment and retention of the cone to different sized hand-held hair dryer barrels.

Referring now to the drawings at FIG. 1 where air concentrating nozzle 10, generally reprsenting the invention throughout the drawings, is shown with cone body 14 laid out in flat patterned shape 12. Flat patterned shape 12 allows cone body 14 to be inexpensively die cut from a thin plastic material, plastic 16, or from a biodegradable material, paper 18. In the FIG. 1 illustration, cone body 14 has two angled sides 20, a curved small first end 22 and a curved large second end 24. Inherent fastener tabs 26 shown right on cone angled side 20 in the FIG. 1 illustration interlock into inherent tab retainer slits 28 shown left in FIG. 1 adjacent the opposite cone angle side 20. Inherent fastener tabs 26 when interlocked into inherent tab retainer slits 28 maintain the cone shape when the material, either plastic 16 or paper 18, is rolled into a cone with the end results being air concentrating nozzle 10. See FIG. 2 and FIG. 3. Elastic loop 30, for fastening air concentration nozzle 10 to home type hand-held hair dryer 34, is attached by elastic loop retainers 32 to large second end 24 of cone body 14. In use, see FIG. 4, with cone body 14 rolled into a cone shape, large second end 24 provides a large end opening so cone body 14 can be slid over hair dryer barrel 36 and elastic loop 30 is looped around the housing of home type hand-held hair dryer 34. When home type hand-held hair dryer 34 is attached to an electrical outlet by electric cord 38 and turned on, hot air 46 passing through hair dryer barrel 36 is concentrated through a small opening formed by small first end 22 of cone body 14. This hot air 46 concentration is sufficient to shrink heat shrink plastic covering 44 tightly to shovel handle 42 of shovel 40 as the illustration at FIG. 4 shows. With air concentration nozzle 10 attached as shown, hot air 46 can be directed up, down, and around shovel handle 42 and heat shrink plastic covering 44 will conform tightly to shovel handle 42. By using air concentrating nozzle 10 with home type hand-held hair dryer 34, it is conceivable that concentrated hot air 46 could be used in a variety of applications which did not require an extremely hot air flow. FIG. 5 and FIG. 6 illustrate alternate methods for retaining cone body 14 on hair dryer barrel 36. In FIG. 5, compression fins 50 are shown as inherent structures longitudinally aligned inside of air concentration nozzle 10 with cone body 14 shown in dotted lines as cone outline 48. FIG. 6 shows air concentration nozzle 10 inherently structured with a spiral retainer thread 52 inside cone body 14 which is shown as cone outline 48. Both methods retain cone body 14 attached by pressure to hair dryer barrel 36. The cone shape of cone body 14 allows a single air concentration nozzle 10 to fit different sized hair dryer barrels 36 by universal attachment.

As the configuration of the immediate invention is quite simple, it is conceivable that those skilled in the art could alter the device and produce similar results, therefore, descriptions in the foregoing specification and illustrations in the drawings are simply meant to describe the attachable cone concept and not limit it to a particular form so long as the form used or changes made to the original device as described remain within the intended scope of the appended claims. Changes made by others to my device and other similar devices which fall within my claim scope will be considered my invention.

What I claim is:

1. An air concentration nozzle comprising a flat patterned body rolled into a cone, said cone having a small first end opening for concentrating air passed therethrough and a large second end opening sized for fitting over air discharge ends of different sized hand-held hair dryer barrels, said cone having sufficient taper interiorly for the barrel ends to bottom out within said cone according to diametric requirements of each of the hand-held hair dryer barrels with said taper providing said cone with universal fitting compatible with the hand-held hair dryer barrels, said cone having means affixed thereto providing releasable attachment of said cone over the barrels of the hair dryers.

2. The air concentration nozzle of claim 1 wherein said flat patterned body rolled into said cone is retained in cone shape through inherent fasteners aligning sides of said flat patterned body having means for interlocking in a manner providing attachment for said sides whereby maintaining said flat patterned body rolled into said cone.

3. The air concentration nozzle of claim 2 wherein said flat patterned body with said inherent fasteners is suitable shaped for die cutting multiples of same from thin plastic and paper materials.

4. The air concentration nozzle of claim 1 with said cone having means affixed thereto providing releasable attachment of said cone over the barrels of the hair dryers, wherein said means providing releasable attachment is an elastic band sufficiently long to be place around a hair dryer with said cone place over the hair dryer barrel.

* * * * *